US009689594B2

(12) United States Patent
Johnson et al.

(10) Patent No.: US 9,689,594 B2
(45) Date of Patent: Jun. 27, 2017

(54) EVAPORATOR, AND METHOD OF CONDITIONING AIR

(75) Inventors: Mark W. Johnson, Racine, WI (US); Eric P. Steinbach, Racine, WI (US); George A. Baker, Waterford, WI (US); Bradley C. Engel, Waterford, WI (US); Gregory T. Kohler, Waterford, WI (US)

(73) Assignee: Modine Manufacturing Company, Racine, WI (US)

( * ) Notice: Subject to any disclaimer, the term of this patent is extended or adjusted under 35 U.S.C. 154(b) by 1142 days.

(21) Appl. No.: 13/544,027

(22) Filed: Jul. 9, 2012

(65) Prior Publication Data

US 2014/0007600 A1 Jan. 9, 2014

(51) Int. Cl.

| | |
|---|---|
| ***F25B 39/02*** | (2006.01) |
| ***F28F 9/02*** | (2006.01) |
| ***F28D 1/053*** | (2006.01) |
| *F28D 21/00* | (2006.01) |

(52) U.S. Cl.

CPC ..... *F25B 39/028* (2013.01); *F28D 1/05391* (2013.01); *F28F 9/02* (2013.01); *F28F 9/0246* (2013.01); *F28D 2021/0068* (2013.01)

(58) Field of Classification Search

CPC ..... F25B 39/00; F25B 39/02; F25B 39/022; F25B 39/024; F25B 39/028

USPC ..... 62/515, 519, 524, 525; 165/173, 175

See application file for complete search history.

(56) References Cited

U.S. PATENT DOCUMENTS

| | | | |
|---|---|---|---|
| 5,086,835 | A | 2/1992 | Schinmura |
| 5,531,268 | A | 7/1996 | Hoshino et al. |
| D402,356 | S | 12/1998 | Hodge |
| 6,860,916 | B2 | 3/2005 | Kubokawa et al. |
| 7,051,796 | B2 | 5/2006 | Kamiyama et al. |
| D538,418 | S | 3/2007 | Pippel et al. |

(Continued)

FOREIGN PATENT DOCUMENTS

| | | | |
|---|---|---|---|
| AT | EP 1031805 A2 * | 8/2000 | ..... F28D 1/04 |
| JP | S63-297947 | 5/1988 | |

(Continued)

OTHER PUBLICATIONS

Machine Translation for Higashiyama JP2009-097776.*

(Continued)

*Primary Examiner* — Jianying Atkisson

*Assistant Examiner* — Antonio R Febles

(74) *Attorney, Agent, or Firm* — Michael Best & Friedrich LLP

(57) ABSTRACT

An evaporator includes an inlet manifold, an outlet parallel to the inlet manifold, and a collection manifold parallel and adjacent to the outlet manifold. First flow conduits extend from the inlet manifold to the collection manifold, and at least one second flow conduit extends from the collection manifold to the outlet manifold. The evaporator can be housed within an enclosure to provide a cased evaporator. Air is conditioned by transferring heat from the air to refrigerant as the air passes through the evaporator. The refrigerant is received from outside the enclosure into the inlet manifold, and is directed through first and second refrigerant passes to receive heat from the air. The flow of refrigerant is received from the second pass into a collection manifold, is transferred to an outlet manifold, and is removed from the enclosure.

17 Claims, 9 Drawing Sheets

(56) References Cited

U.S. PATENT DOCUMENTS

| | | | | |
|---|---|---|---|---|
| 7,548,683 | B2 | 6/2009 | Valensa et al. | |
| D605,274 | S | 12/2009 | Kawano et al. | |
| 7,921,904 | B2 | 4/2011 | Matter et al. | |
| 8,464,550 | B2 | 6/2013 | Kerler et al. | |
| D717,932 | S | 11/2014 | Mross et al. | |
| 2003/0221819 | A1 | 12/2003 | Jang | |
| 2004/0187517 | A1* | 9/2004 | Solomon | 62/404 |
| 2004/0244953 | A1* | 12/2004 | Kamiyama et al. | 165/140 |
| 2005/0006070 | A1 | 1/2005 | Kamiyama et al. | |
| 2006/0054310 | A1* | 3/2006 | Kim | F25B 39/02 165/110 |
| 2006/0236718 | A1* | 10/2006 | Lundberg | 62/515 |
| 2008/0302131 | A1* | 12/2008 | Higashiyama | 62/515 |
| 2010/0012305 | A1* | 1/2010 | Taras et al. | 165/175 |
| 2010/0115771 | A1 | 5/2010 | Johnson et al. | |
| 2011/0139425 | A1* | 6/2011 | Beamer | 165/175 |
| 2011/0203780 | A1 | 8/2011 | Jiang et al. | |
| 2011/0240271 | A1 | 10/2011 | Mross et al. | |
| 2012/0024509 | A1 | 2/2012 | Ueno | |
| 2013/0126140 | A1* | 5/2013 | Park et al. | 165/173 |
| 2014/0007600 | A1 | 1/2014 | Johnson et al. | |

FOREIGN PATENT DOCUMENTS

| | | | |
|---|---|---|---|
| JP | 2009097776 | A * | 5/2009 |
| JP | 2010-276321 | | 9/2010 |
| WO | WO 2011023327 | A1 * | 3/2011 |

OTHER PUBLICATIONS

First Office Action from the State Intellectual Property Office of the People's Republic of China for Application No. 201310054602.0 dated Mar. 30, 2016 (16 pages).

Second Office Action from the State Intellectual Property Office of China for Application No. 201310054602.0 dated Dec. 7, 2016 (29 pages).

Office Action from the Japanese Intellectual Property Office for Application No. 2012-194929 dated Oct. 4, 2016 (20 pages).

* cited by examiner

EVAPORATOR, AND METHOD OF CONDITIONING AIR

FIELD OF THE INVENTION

The present application relates to heat exchangers, and especially relates to heat exchangers operating as evaporators to condition air.

BACKGROUND

Vapor compression systems are commonly used for refrigeration and/or air conditioning and/or heating, among other uses. In a typical vapor compression system, a refrigerant, sometimes referred to as a working fluid, is circulated through a continuous thermodynamic cycle in order to transfer heat energy to or from a temperature and/or humidity controlled environment and from or to an uncontrolled ambient environment. While such vapor compression systems can vary in their implementation, they most often include at least one heat exchanger operating as an evaporator, and at least one other heat exchanger operating as a condenser.

In systems of the aforementioned kind, a refrigerant typically enters an evaporator at a thermodynamic state (i.e., a pressure and enthalpy condition) in which it is a subcooled liquid or a partially vaporized two-phase fluid of relatively low vapor quality. Thermal energy is directed into the refrigerant as it travels through the evaporator, so that the refrigerant exits the evaporator as either a partially vaporized two-phase fluid of relatively high vapor quality or a superheated vapor. This thermal energy is often sensible and/or latent heat that is removed from a flow of air in order to condition that flow of air prior to delivering the air to the temperature and/or humidity controlled environment.

At another point in the system the refrigerant enters a condenser as a superheated vapor, typically at a higher pressure than the operating pressure of the evaporator. Thermal energy is rejected from the refrigerant as it travels through the condenser, so that the refrigerant exits the condenser in an at least partially condensed condition. Most often the refrigerant exits the condenser as a fully condensed, sub-cooled liquid.

Some vapor compression systems are reversing heat pump systems, capable of operating in either an air conditioning mode (such as when the temperature of the uncontrolled ambient environment is greater than the desired temperature of the controlled environment) or a heat pump mode (such as when the temperature of the uncontrolled ambient environment is less than the desired temperature of the controlled environment). Such a system may require heat exchangers that are capable of operating as an evaporator in one mode and as a condenser in an other mode.

One especially useful type of heat exchanger used in some refrigeration systems is the parallel flow (PF) style of heat exchanger. Such a heat exchanger can be characterized by having multiple, parallel arranged channels, especially micro-channels, for conducting the refrigerant through the heat transfer region from an inlet manifold to an outlet manifold.

SUMMARY

In some embodiments of the invention, an evaporator includes an inlet manifold with a fluid inlet port arranged at one end, and a fluid distributor arranged within the inlet manifold and connected to the fluid inlet port. An outlet manifold having a fluid outlet port at one end is arranged parallel to the inlet manifold, and a collection manifold is arranged parallel and adjacent to the outlet manifold. A plurality of first flow conduits extend from the inlet manifold to the collection manifold, and at least one second flow conduit extends from the collection manifold to the outlet manifold.

In some embodiments, the inlet manifold is adjacent to at least one of the outlet manifold and the collection manifold. In some embodiments an intermediate header is arranged at an end of the evaporator opposite the inlet manifold and the collection manifold.

According to some embodiments of the invention, a method of conditioning air includes directing a flow of air into an air inlet of an enclosure, through the air side of an evaporator housed within the enclosure, and removing the flow of conditioned air from the enclosure through an air outlet. Heat is transferred heat from the flow of air to a flow of refrigerant as the flow of air passes through the evaporator in order to condition the air. The flow of refrigerant is received from a location external to the enclosure into an end of an inlet manifold arranged within the enclosure, and is directed through first and second refrigerant passes in order to receive heat from the air, with the refrigerant flowing in opposing directions in the first and second passes. The flow of refrigerant is received from the second pass into a collection manifold, is transferred to an outlet manifold, and is removed to a location external to the enclosure.

In some embodiments the flow direction of refrigerant in the first pass is oriented at an acute angle to the flow of air entering the enclosure. In some embodiments the flow of air encounters the second refrigerant pass prior to encountering the first refrigerant pass. In some embodiments the flow of refrigerant is transferred from the first refrigerant pass to the second refrigerant pass within an intermediate header located at an end of the evaporator opposite the inlet manifold and the collection manifold.

In some embodiments of the invention a cased evaporator includes an enclosure having an inlet side to allow for air flow into the cased evaporator, an outlet side spaced apart from and parallel to the inlet side to allow for air flow out of the cased evaporator, and a plurality of side walls extending between the inlet and outlet side. An evaporator is arranged within the enclosure and includes an air inlet core face arranged at an acute angle to the inlet side of the enclosure and an air outlet core face spaced apart from and parallel to the air inlet core face. An inlet manifold, an outlet manifold, and a collection manifold are located at a common end of the evaporator core. A refrigerant inlet port extends through one of side walls into the inlet manifold, and a refrigerant outlet port extends through one of the side walls into the outlet manifold. A plurality of first flow conduits extends through the evaporator core from the inlet manifold to the collection manifold, and at least one second flow conduit extending from the collection manifold to the outlet manifold.

In some embodiments a condensate tray is arranged within the enclosure and is directly below the inlet manifold, the outlet manifold, and the collection manifold when the cased evaporator is in an operating orientation. In some embodiments the refrigerant inlet port and the refrigerant outlet port are located adjacent to one another. In some embodiments the collection manifold is arranged between planes defined by the air inlet core face and the air outlet core face.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

An exemplary embodiment according to some aspects of the present invention is shown and described by FIGS. 1-4. The exemplary embodiment includes an evaporator 1 that is especially useful for transferring latent and/or sensible heat from a flow of air to a flow of refrigerant, to thereby vaporizer the refrigerant from an at least partially liquid state to a superheated vapor state. In other applications such an evaporator 1 may operate as an evaporator in a first mode of operation, and as a condenser in a second mode of operation. In still other applications the evaporator 1 may find utility in other types of systems such as, for example, a Rankine cycle power generation system.

Figure 5:
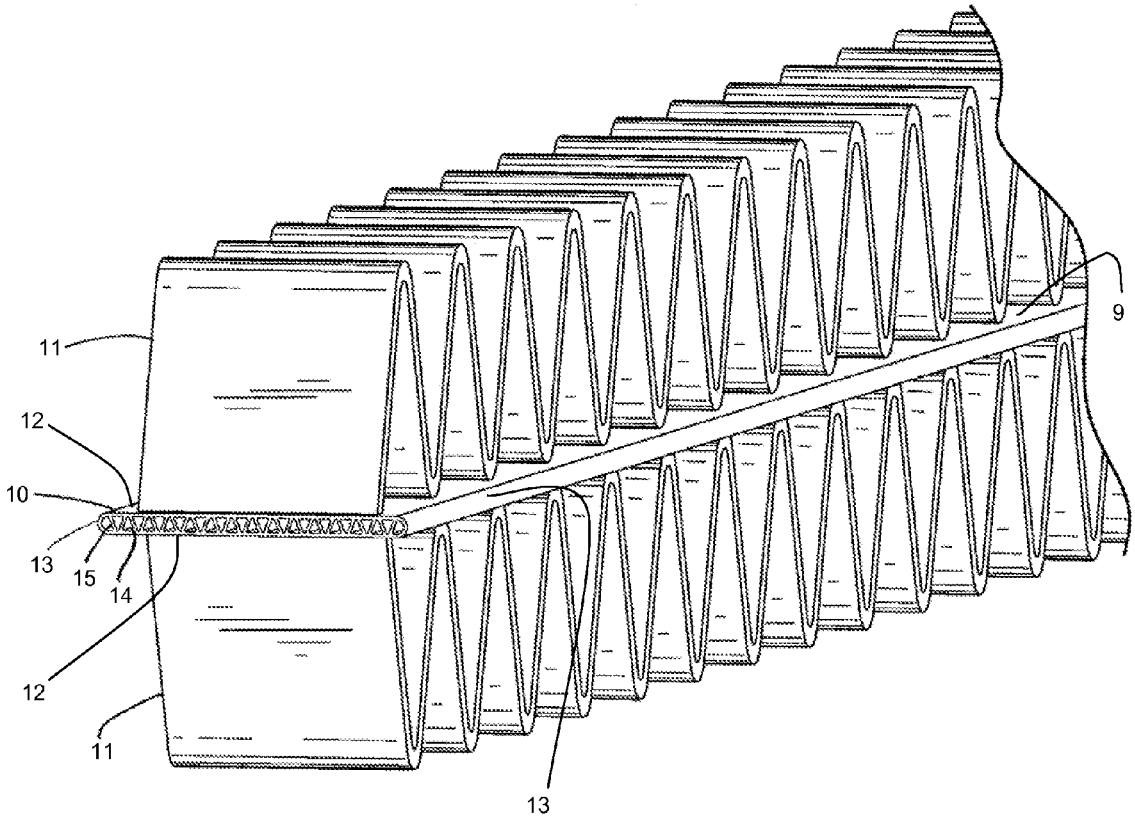
FIG. 5 is a partial perspective view of a fin and tube combination for use in the evaporator of FIG. 1.

The exemplary evaporator 1 is of a parallel flow tube and fin construction. A plurality of flat tubes 9 are arranged into two parallel banks 9*a* and 9*b*, with convoluted serpentine fin structures 11 arranged between adjacent flat tubes 9 in each bank. A typical repeating section of fin structure 11 and flat tube 9 are shown in detail in FIG. 5. With specific reference to FIG. 5, the flat tube 9 includes two spaced apart broad, flat sides 12 joined by two short, arcuate sides 13. Crests of the convolutions of the fin structures 11 are joined to the broad and flat sides 12 of the tubes 9, for example by brazing. Internal web structures 15 are disposed in the interior of the flat tubes 9 in order to divide the internal volume of the flat tube 9 into a plurality of flow channels 14 of relatively small hydraulic diameter, whereby the refrigerant can be transported through the flat tubes 9. Air can be directed through channels formed by the convolutions of the fin structures 11 and the broad and flat surfaces 12 of the tubes 9, so that effective heat transfer between the flow of air and the flow of refrigerant is enabled. The assembly of fin structures 11 and flat tubes 9 is referred to as the evaporator core 39.

The evaporator core 39 is bounded between planes defined by first and second core faces 25 and 26. In some embodiments the first core face 25 functions as an air inlet core face and the second core face 26 functions as an air outlet core face. In other embodiments the direction of the air flow is reversed, so that the first core face 25 functions as an air outlet core face and the second core face 26 functions as an air inlet core face.

With continuing reference to FIGS. 1-4, the flat tubes 9*a* of a first bank of the evaporator 1 extend from an inlet manifold 2 arranged at a first end of the evaporator 1 to an intermediate header 31 arranged at an opposite second end of the evaporator 1. Similarly, the flat tubes 9*b* of a second bank of the evaporator 1 extend from the intermediate header 31 to a collection manifold 3 arranged at the first end of the evaporator 1, adjacent to the first manifold 2. Fluid flow traveling through the flat tubes 9*a* can be received within flow passages contained in the intermediate header 31, and can be transferred to the second plurality of tubes 9*b*, or vice versa. An exemplary embodiment of such an intermediate header 31 is described in currently pending U.S. patent application Ser. No. 13/076,607 to Mross et al., filed on Mar. 31, 2011, the entire contents of which are incorporated by reference herein. It should be understood, however, that the intermediate header 31 can alternatively be of other constructions, and in some embodiments the intermediate header 31 can be eliminated altogether. For example, in some embodiments the evaporator 1 may include a single bank of tubes 9 extending from the inlet manifold 2 to the collection manifold 3.

Figure 3:
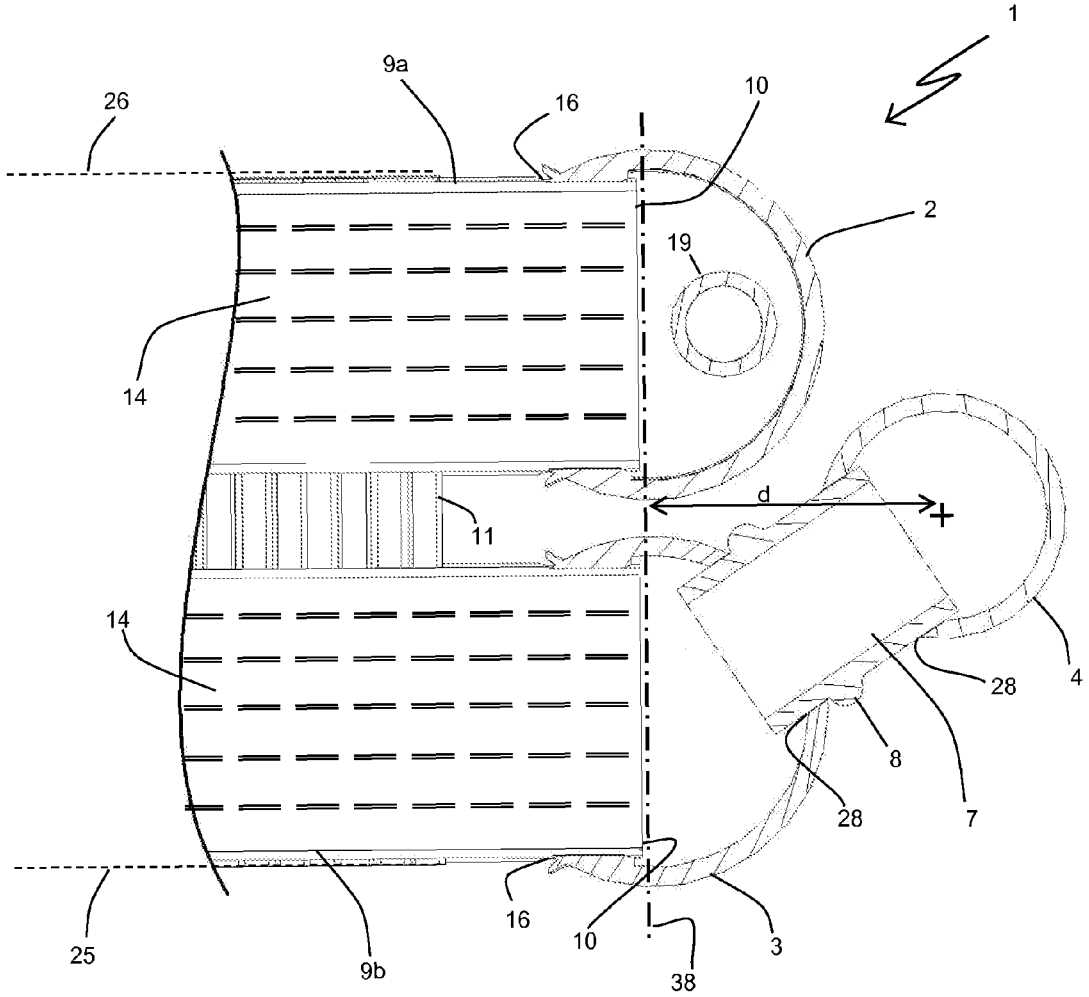
FIG. 3 is a sectional view along the lines III-III of FIG. 2.
Figure 4:
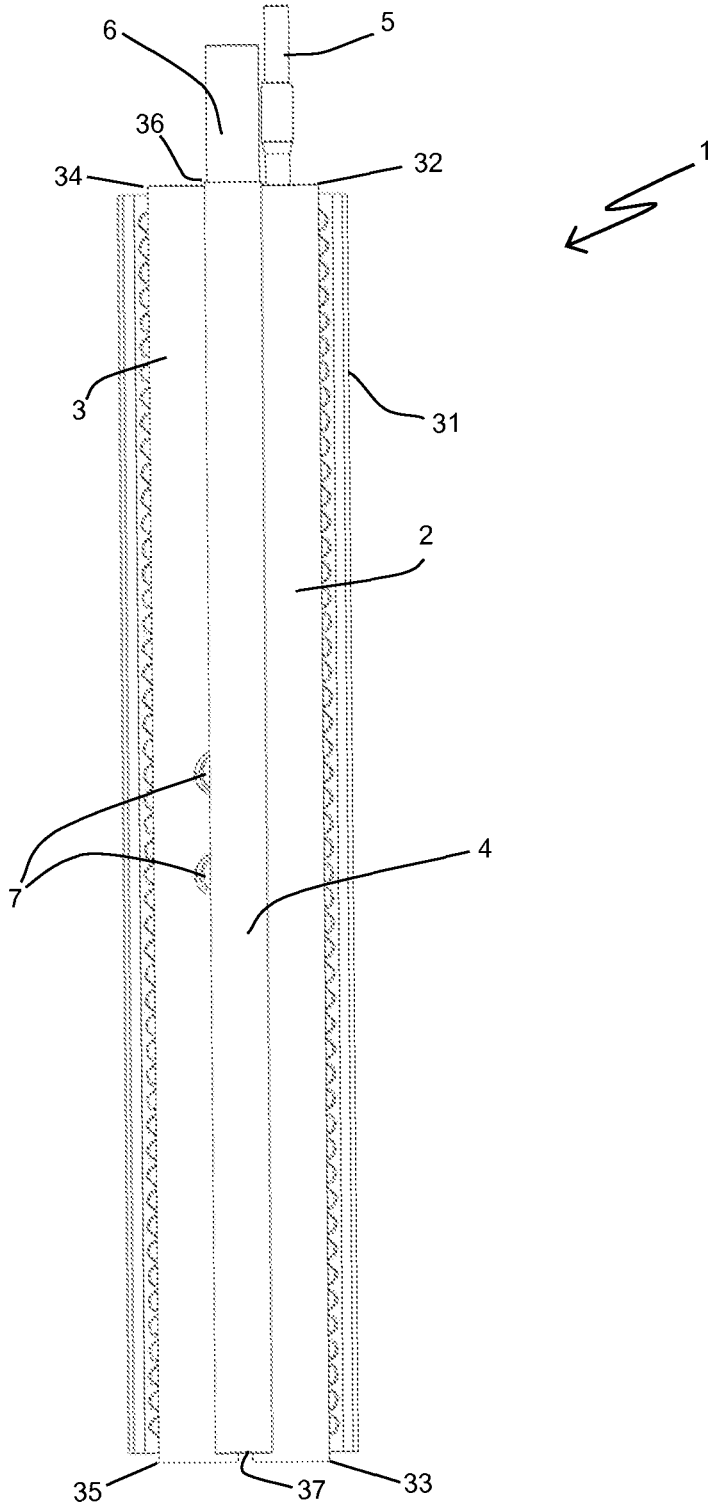
FIG. 4 is an elevation view of the evaporator of FIG. 1

As best seen in FIG. 3, the outlet manifold 4 is entirely located between the parallel planes defined by the core faces 25 and 25. At least a portion of the inlet manifold 2 and the collection manifold 3, and preferably, most of the inlet manifold 2 and the collection manifold 3, are similarly located between the parallel planes defined by the core faces 25 and 26.

Figure 1:
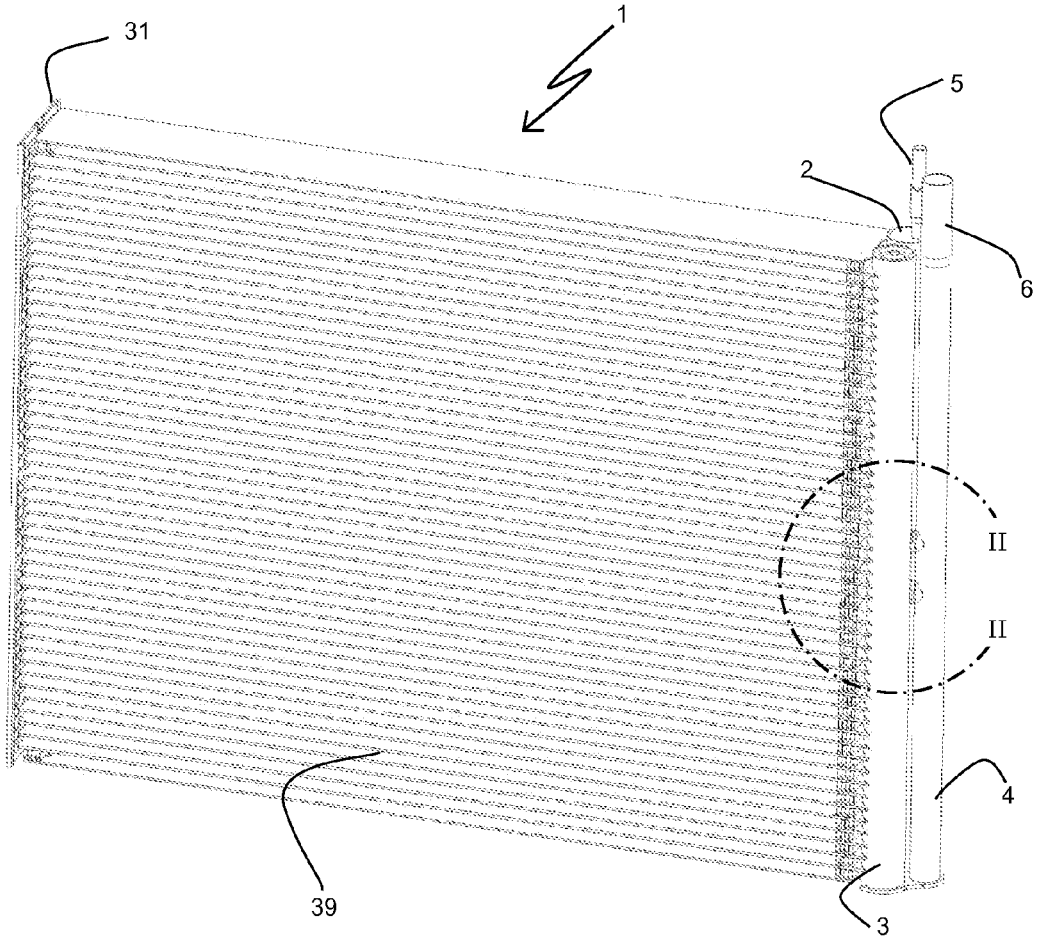
FIG. 1 is a perspective view of an evaporator according to an embodiment of the invention.
Figure 2:
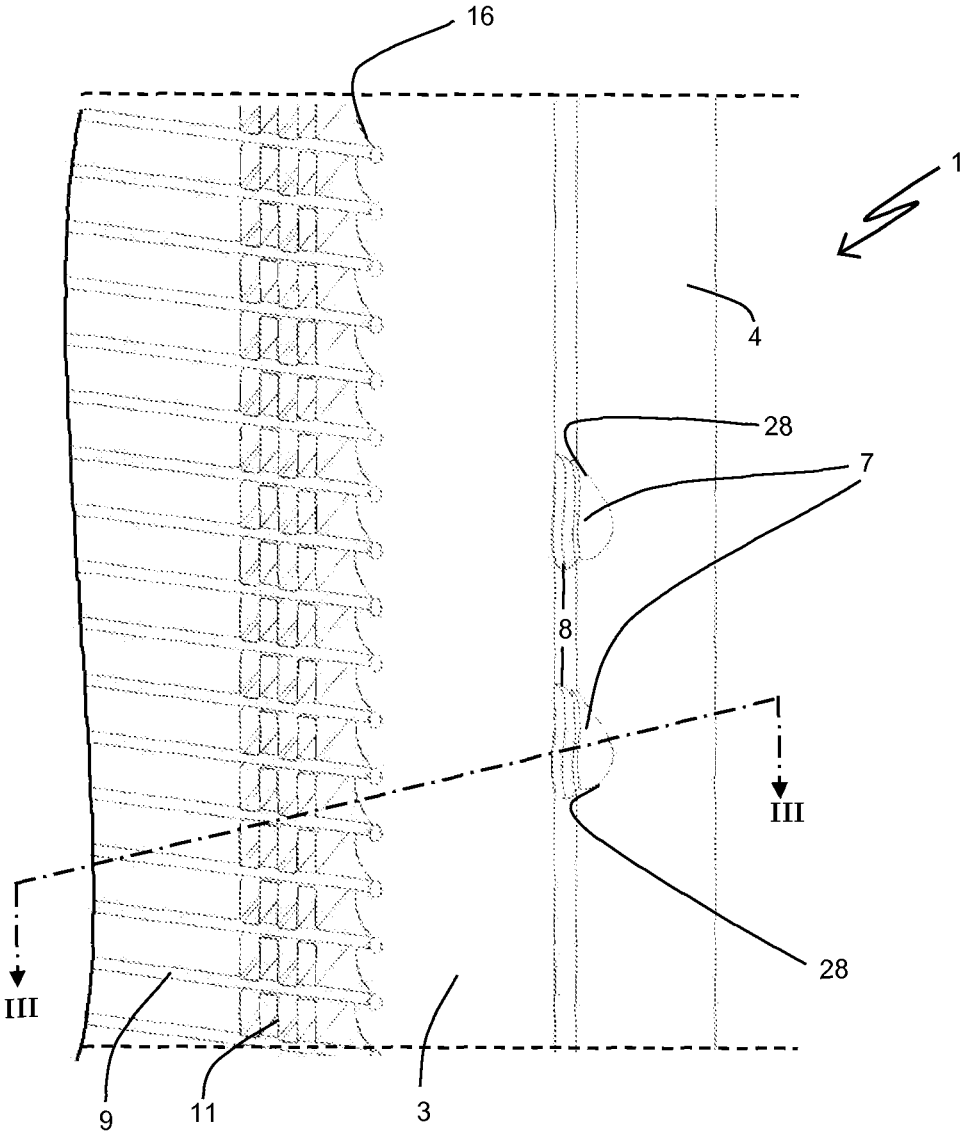
FIG. 2 is a detailed view of the section II-II of FIG. 1.

For the sake of clarity, only portions of the convoluted fin structures 11 are shown in FIGS. 1 and 2. It should be understood that in some (but not necessarily all) embodiments the fin structures 11 will extend the entire width of the core 39 from the manifolds 2, 3 to the intermediate header 31. In the exemplary embodiment the flat tubes 9*a* and the flat tubes 9*b* are arranged in alignment with one another so that a continuous fin structure 11 can be common to both the first and second banks of flat tubes 9 (best seen in FIG. 3). In some embodiments, however, it may be preferable to use separate fin structures 11 for each bank of flat tubes.

The inlet manifold 2 extends from a first end 32 to a second end 33. A plurality of slots 16 are arranged along the longitudinal length of the inlet manifold 2, and ends 10 of the first bank of tubes 9*a* are sealingly received within the slots 16. A fluid inlet port 5 is located at the first end 32, and is in fluid communication with a flow distribution device 19 arranged within the inlet manifold 2. The flow distribution device 19 of the exemplary embodiment is best seen in FIG. 3. In the exemplary embodiment the flow distribution device 19 includes a cylindrical tube extending at least some of the length of the inlet manifold 2, and in certain embodiments extends the full length. Orifices (not shown) are arranged along the length of the flow distribution device 19 in order to evenly distribute a flow of refrigerant received from the fluid inlet port 5 to the flow channels 14 within the bank of flat tubes 9*a*. It should be understood that many other types of flow distribution devices are known in the art, and can be similarly substituted without departing from the spirit and scope of the present invention.

The collection manifold 3 extends from a first end 34 to a second end 35. A plurality of slots 16 are arranged along the longitudinal length of the collection manifold 2, and ends 10 of the second bank of tubes 9*b* are sealingly received within the slots 16. An outlet manifold 4 is arranged at the first end of the evaporator 1 adjacent to the inlet manifold 2 and the collection manifold 3. The outlet manifold 4 extends from a first end 36 to a second end 37, and a fluid outlet port 6 is located at the end 36, although in some embodiments the fluid outlet port 6 is alternatively arranged at the end 37. In some (but not all) embodiments some or all of the first ends 32, 34, and 36 are approximately coplanar. Similarly, in some (but not all) embodiments some or all of the second ends 33, 35, and 37 are coplanar.

Flow conduits 7 extend between the collection manifold 3 and the outlet manifold 4. Corresponding apertures 32 are provided in the side walls of the manifolds 3, 4 in order to sealingly receive the ends of the flow conduits 7 therein. A saddle feature 8 is preferably provided around the outer periphery of each of the flow conduits in order to aid in the assembly of the flow conduits 7 to the manifolds 3, 4. The manifold 3, the manifold 4, and the flow conduits 7 are preferably joined in a brazing operation, although they can also be joined by other processes such as welding, gluing, etc. In some especially preferable embodiments, some or all of the other components of the evaporator 1 (e.g. the tubes 9, the fin structures 11, the inlet manifold 2, the intermediate header 31, the ports 5 and 6) are also joined in the same operation.

In some embodiments it may be especially preferable to locate the outlet manifold 4 at least partially within the space between the inlet manifold 2 and the collection manifold 3, as shown FIG. 3. This arrangement can provide for an advantageously compact arrangement of the manifolds 2, 3, and 4. In some such embodiments the distance "d" between the longitudinal axis of the outlet manifold 4 and a plane passing through the longitudinal axes of the manifolds 2 and 3 is less than half of the sum of the outer diameters of the manifolds 2 and 4.

Although the inlet manifold 2, the collection manifold 3, and the outlet manifold 4 are all shown as having a circular cross-section, it should be understood that one or more of the manifolds can have a cross-section that is other than circular, including but not limited to square, hexagonal, octagonal, or oval. In some embodiments the outlet manifold 4 can be smaller in cross-sectional area or diameter than one or both of the manifolds 2, 3. In some especially preferable embodiments the outlet manifold 4 can be similar in size and/or shape to the outlet port 6.

The principles of operation of the evaporator 1 within a vapor-compression system 40 will now be described, with particular reference to the schematic diagram of FIG. 6. The vapor compression system 40 includes a compressor 33, a condenser 35, an expansion device 34, and the evaporator 1. The compressor 33 operates to direct the refrigerant working fluid through the system 40. Superheated vapor refrigerant at an elevated temperature and pressure is directed from the compressor 40 to the condenser 35, wherein heat is rejected from the refrigerant in order to cool and condense the refrigerant to a high pressure, sub-cooled liquid. The compressor 33 and condenser 35 are commonly arranged in close proximity to one another, and are commonly packaged within a single device.

Figure 6:
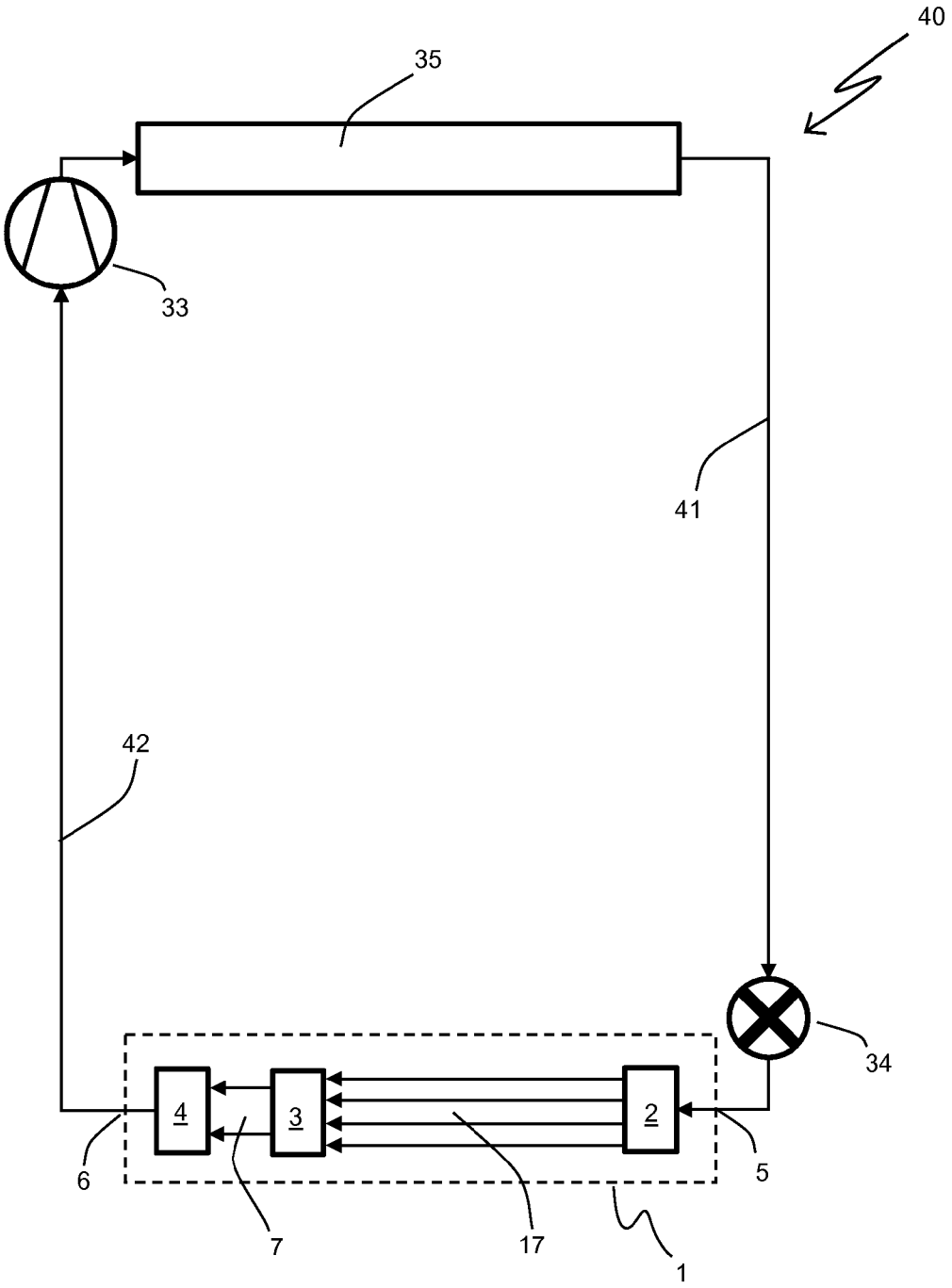
FIG. 6 is a schematic diagram of a vapor compression system configured to receive the benefit of some embodiments of the invention.
Figure 7:
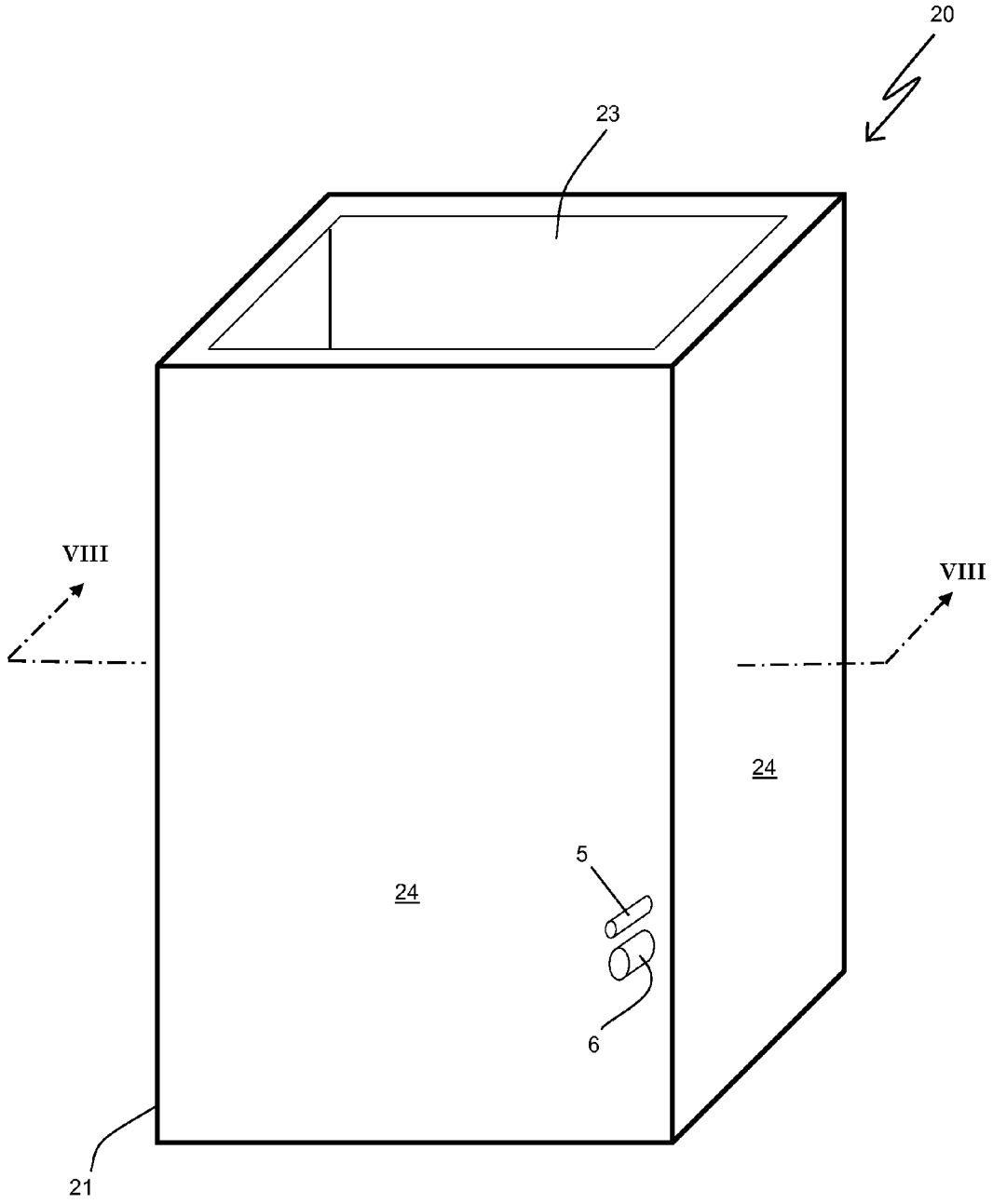
FIG. 7 is a perspective view of a cased evaporator according to another embodiment of the invention.
Figure 8:
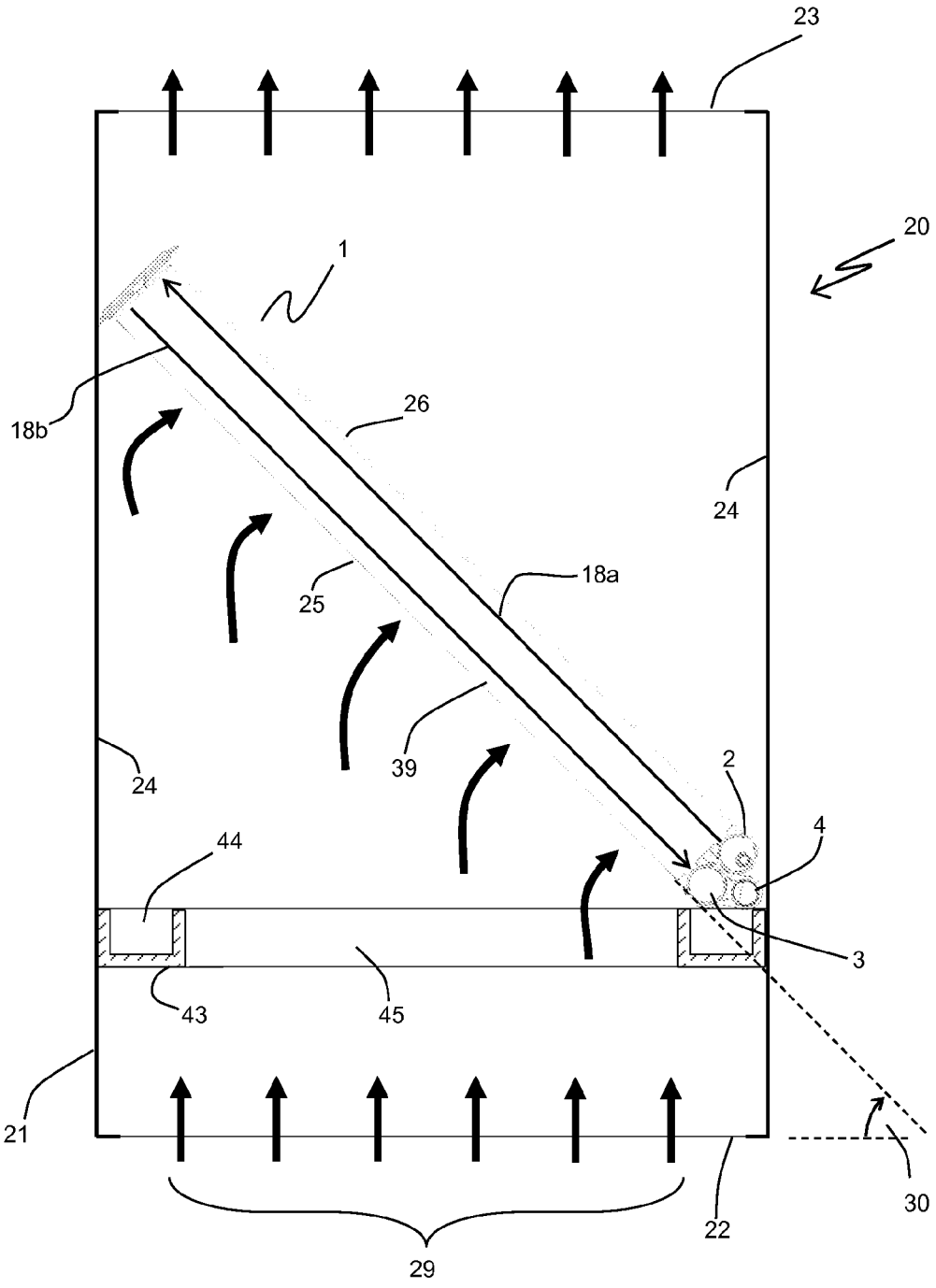
FIG. 8 is a sectional view along the lines VIII-VIII of FIG. 7.

Continuing with reference to FIG. 6, the high pressure, sub-cooled liquid refrigerant is directed through piping (commonly referred to as the "liquid line") 41 to the expansion device 34. The expansion device 34 can be a thermostatic valve, an electronically controllable expansion device, a fixed orifice, or any other type of expansion device commonly used in vapor compression systems to expand the refrigerant from a high pressure, sub-cooled liquid to a low pressure liquid or liquid-vapor mixture. The expansion device 34 is typically provided in close proximity to the fluid inlet 5 of the evaporator 1.

The expanded refrigerant, now at a relatively low temperature and pressure, is directed through the fluid inlet port 5 to the inlet manifold 2. The refrigerant is distributed to a plurality of flow conduits 17 that extend from the inlet manifold 2 to the collection manifold 3. By way of example, the plurality of flow conduits 17 can comprise the channels 14 of the tubes 9, as well as the flow passages of the intermediate header 31. The refrigerant is vaporized and partially superheated as it travels through the plurality of flow conduits 17. Next, the refrigerant is transferred through the flow conduits 7 to the exit manifold 4, and is removed from the evaporator 1 through the fluid outlet port 6 as a low pressure, superheated vapor. The low pressure, superheated vapor is returned to the inlet of the compressor 33 through piping (commonly referred to as the "suction line") 42.

The compressor 33 and condenser 35 are oftentimes located a substantial distance away from the expansion device 34 and evaporator 1. As an example, the compressor 33 and condenser 35 may be located external to a building so that heat rejected from the refrigerant within the condenser 35 can be readily transferred to the outside air, while the evaporator 1 and expansion device 34 may be located in a portion of the building dedicated to heating and cooling equipment. As a result, the liquid line 41 and suction line 42 are commonly provided as a single "line set" to extend between these two disparate locations.

In order to simplify the connection of a line set comprising the liquid line 41 and the suction line 42 to the expansion device 34 and evaporator 1, it can be highly advantageous to locate the fluid inlet port 5 and fluid outlet port 6 of the evaporator 1 immediately adjacent to one another, such as by arranging the ports 5, 6 at the adjacent ends 32, 36. This allows the installer to terminate the line set at a common location. However, such an arrangement of the fluid ports 5, 6 can substantially decrease the uniformity of the flow distribution between the plurality of flow conduits 17, as those conduits closer to the ports 5, 6 will tend to receive a substantially greater share of the total refrigerant flow than will those conduits located further away. Such maldistribution can lead to several undesirable effects, such as under-conditioning of the air, decreased system stability, and lower achievable heat duty in the evaporator.

The inventors have found that by appropriate selection of the number, size, and location of the flow conduits 7, the aforementioned maldistribution can be substantially eliminated. By first receiving the refrigerant from the flow conduits 17 in the collection manifold 3, then transferring the refrigerant through the flow conduits 7 to the exit manifold 4, the flow conduits 17 can all be made to be equally preferable flow paths. While the exemplary embodiments show two flow conduits 7, it should be understood that in some cases more or fewer flow conduits 7 may be preferable. In addition, it may be preferable for some of the flow conduits 7 to have a flow area that is greater than some other of the flow conduits 7. In some embodiments it may be preferable for a flow conduit 7 arranged closer to the fluid outlet port 6 to have a smaller flow area than a flow conduit 7 arranged further from the fluid outlet port 6.

According to another embodiment of the invention, a cased evaporator 20 is provided and includes an evaporator 1 arranged within an enclosure 21. The cased evaporator 20 can advantageously function as a plenum section within a central heating and cooling system. In some embodiments the case evaporator 20 can be mounted directly downstream of an air mover device and/or a furnace or other heating device.

The enclosure 21 includes an air inlet 22 arranged on one face of the enclosure 21, and an air outlet 23 arranged on an opposing face of the enclosure 21. Side walls 24 extend between the air inlet 22 and the air outlet 23, and provide a ducted air flow path for a flow of air 29 to pass through the cased evaporator from the air inlet 22 to the air outlet 23. An evaporator 1 is arranged within the enclosure 21 so that the air flow path extends through the core 39 of the evaporator 1. The inlet port 5 and the outlet port 6 extend through one of the sides 24 and are located adjacent to one another so that assembly of a suction line 42 and an expansion device 34 and liquid line 41 to the ports 6 and 5, respectively, is simplified.

The evaporator 1 is arranged within the enclosure 21 so that the air inlet core face 25 is oriented at an acute angle 30 to the air inlet 22. In some preferable embodiments the acute angle 30 is between thirty and sixty degrees, and is some highly preferable embodiments the acute angle 30 is about forty-five degrees.

With the evaporator 1 so arranged within the enclosure 21, the flow of air 29 enters the cased evaporator 20 through the air inlet 22, is cooled and conditioned by rejecting heat to the refrigerant as it passes through the core 39 of the evaporator 1, and is removed from the cased evaporator 20 through the air outlet 23. The flow of refrigerant is received from a location external to the enclosure 21 into an end of the inlet manifold 2, by way of the fluid inlet port 5 extending through a side 24 of the enclosure 21. The flow of refrigerant is directed through a first refrigerant pass 18*a* comprising the flow channels 14 within the bank of flat tubes 9*a*.

At an end of the evaporator 1 opposite the inlet manifold 2, the flow of refrigerant is transferred through the intermediate header 37 from the first refrigerant pass 18*a* to a second refrigerant pass 18*b* flowing in a direction opposite to the direction of flow in the pass 18*a*, the pass 18*b* comprising the flow channels 14 within the bank of flat tubes 9*b*. The flow of refrigerant is received into the collection manifold 3 and is transferred by way of the flow conduits 7 to the outlet manifold 4. The flow of refrigerant is removed from an end of the outlet manifold 4 to a location external to the enclosure 21 by way of the fluid outlet port 6.

With the evaporator 1 arranged as shown inside the enclosure 21, the flow direction of the refrigerant in the first pass 18*a* is oriented at an acute angle to the flow direction of the air 29 as it enters the air inlet 22. Specifically, the acute angle between these flow directions is the complement of the acute angle 30. In the exemplary embodiment the flow of air encounters the second refrigerant pass 18*b* prior to encountering the first refrigerant pass 18*a*. In some other embodiments, however, the flow of air may encounter the refrigerant passes in a reversed order.

In some preferred embodiments the flow of refrigerant received into the inlet manifold 2 is at least partially liquid. As the refrigerant is directed along the first refrigerant pass 18*a*, a first quantity of heat is transferred from the flow of air 29 into the refrigerant. Furthermore, as the refrigerant is directed along the second refrigerant pass 18*b*, a second quantity of heat is transferred from the flow of air 29 into the refrigerant. In some preferred embodiments the flow of refrigerant is vaporized by receiving the first and second quantities of heat, and in some embodiments the flow of refrigerant is partially superheated by receiving the first and second quantities of heat.

A condensate tray 43 can be optionally provided within the enclosure 21 of the cased evaporator 20 in order to capture water that has been condensed from the flow of air 29 as that flow of air is cooled and dehumidified. The condensate tray 43 includes a trough 44 to receive the condensate, and an aperture 45 for the flow of air 29 to pass through. The inlet manifold 2, the collection manifold 3, and the outlet manifold 4 are all arranged directly above the trough 44 of the condensate tray 43. Condensate that is formed in the evaporator core 39 as latent heat is removed from the flow of air 29 can travel via capillary action along the arcuate ends 13 of the tubes 9 to the manifolds 2 and 3, and drips down into the trough 44. A condensate drain (not shown) can extend through one of the sides 24 of the enclosure 21 into the trough 44 so that the collected condensate can be removed from the condensate tray 43.

Figure 9:
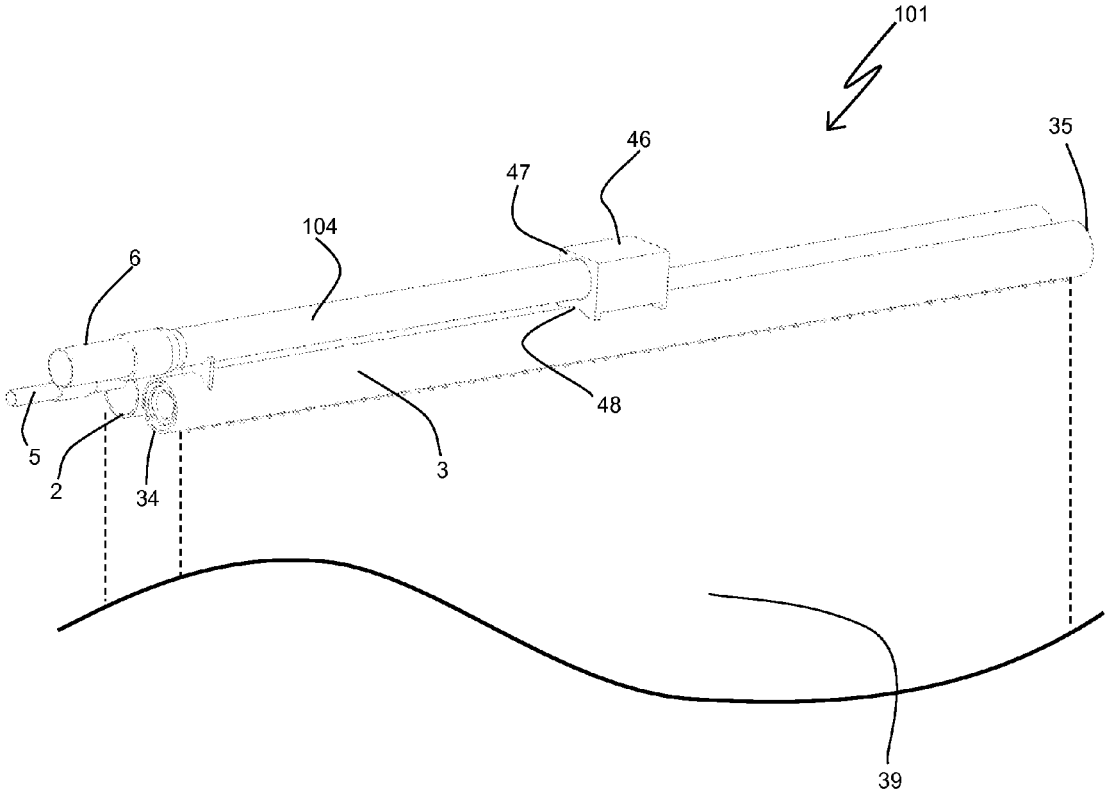
FIG. 9 is a partial perspective view of an evaporator according to another embodiment of the invention.

An alternate embodiment of an evaporator 101 according to the invention is shown in FIG. 9. In general, many of the elements of the evaporator 101 are the same as, or substantially similar to, those of the evaporator 1 described in FIGS. 1-4, and such elements are numbered the same.

The evaporator 101 includes a block 46 connected to the collection manifold 3 at a location between the ends 34, 35. An arcuately shaped face 48 of the block 46 conforms to the outer surface of the manifold 3, and is bonded thereto. The outlet manifold 104 extends from the outlet port 6 to the block 46, extending partway into the block 46 through a face 47. Flow conduits extend into the block 46 through the face 48 in order to transport fluid from the manifold 3 to the manifold 104. Such flow conduits (not visible in FIG. 9) can be, for example, provided by machining of the block 46 prior to joining the block 46 to the manifolds 3 and 104.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

We claim:

1. An evaporator comprising:

an inlet manifold extending longitudinally from a first end to a second end;

a fluid inlet port arranged at one of the first and second ends of the inlet manifold;

a fluid distributor arranged within the inlet manifold and connected to the fluid inlet port to receive flow therefrom;

an outlet manifold extending longitudinally from a first end to a second end, parallel to the inlet manifold;

a fluid outlet port arranged at one of the first and second ends of the outlet manifold;

a collection manifold extending longitudinally from a first end to a second end, parallel and adjacent to the outlet manifold;

a plurality of first flow conduits extending in an extending direction from the inlet manifold to the collection manifold; and at least one second flow conduit extending from the collection manifold to the outlet manifold at an angle oblique to the extending direction of the first flow conduits, wherein a distance between a longitudinal axis of the inlet manifold and a longitudinal axis of the outlet manifold in a direction perpendicular to a plane passing through the longitudinal axis of the inlet manifold and a longitudinal axis of the collection manifold is less than half of the sum of an outer diameter of the inlet manifold and an outer diameter of the outlet manifold.

2. The evaporator of claim 1, wherein the inlet manifold is adjacent to at least one of the outlet manifold and the collection manifold.

3. The evaporator of claim 1, wherein said one of the first and second ends of the inlet manifold and said one of the first and second ends of the outlet manifold are aligned in a common plane normal to the longitudinal direction of the inlet and exit manifolds.

4. The evaporator of claim 1, further comprising a plurality of penetrations arranged along the outlet manifold in one-to-one correspondence to the second flow conduits to sealingly receive ends of the second flow conduits.

5. The evaporator of claim 4, wherein a first one of the plurality of penetrations receives an end of a second flow conduit having a first flow area, a second one of the plurality of penetrations receives an end of a second flow conduit having a second flow area smaller than the first flow area, and the second one of the plurality of penetrations is located between the fluid outlet port and the first one of the plurality of penetrations.

6. The evaporator of claim 1, wherein the length of the outlet manifold is less than the length of the collection manifold.

7. The evaporator of claim 1, wherein the plurality of first flow conduits comprises a plurality of flat tubes, each of said flat tubes comprising:

a first pair of spaced and opposing broad, flat sides;

a second pair of spaced and opposing short, narrow sides; and one or more flow channels extending from a first tube end to a second tube end.

8. The evaporator of claim 1, further comprising:

an intermediate header arranged at an end of the evaporator opposite the inlet manifold and the collection manifold;

a first plurality of flat tubes extending from the inlet manifold to the intermediate header; and a second plurality of flat tubes extending from the intermediate header to the collection manifold, wherein the plurality of first flow conduits extend through the first plurality of flat tubes, the intermediate header, and the second plurality of flat tubes.

9. A cased evaporator for use in a refrigerant system, comprising:

an enclosure having an inlet side to allow for air flow into the cased evaporator, an outlet side spaced apart from and parallel to the inlet side to allow for air flow out of the cased evaporator, and a plurality of side walls extending between the inlet and outlet side; and a heat exchanger arranged within the enclosure, the heat exchanger comprising:

a heat exchanger core;

an air inlet core face arranged at an acute angle to the inlet side of the enclosure;

an air outlet core face spaced apart from and parallel to the air inlet core face;

an inlet manifold, an outlet manifold, and a collection manifold located at a common end of the heat exchanger core;

a refrigerant inlet port extending through one of the plurality of side walls into the inlet manifold;

a refrigerant outlet port extending through one of the plurality of side walls into the outlet manifold;

a plurality of first flow conduits extending through the heat exchanger core in an extending direction from the inlet manifold to the collection manifold; and at least one second flow conduit extending from the collection manifold to the outlet manifold at an angle oblique to the extending direction of the first flow conduits, wherein the outlet manifold is at least partially located within a space between the inlet manifold and the collection manifold, and wherein the outlet manifold is adjacent to one of the plurality of side walls and is adjacent to a condensate tray.

10. The cased evaporator of claim 9, wherein the condensate tray is arranged within the enclosure directly below the inlet manifold, the outlet manifold, and the collection manifold when the cased evaporator is in an operating orientation.

11. The cased evaporator of claim 9, wherein the refrigerant inlet port and the refrigerant outlet port are located adjacent to one another.

12. The cased evaporator of claim 9, the heat exchanger further comprising an intermediate header located at an end of the heat exchanger core opposite the common end, the plurality of first flow conduits extending through the intermediate header.

13. The cased evaporator of claim 9, wherein the collection manifold is located between a first plane defined by the air inlet core face and a second plane defined by the air outlet core face.

14. An evaporator comprising:

an inlet manifold extending longitudinally from a first end to a second end;

a fluid inlet port arranged at one of the first and second ends of the inlet manifold;

a fluid distributor arranged within the inlet manifold and connected to the fluid inlet port to receive flow therefrom;

an outlet manifold extending longitudinally from a first end to a second end, parallel to the inlet manifold;

a fluid outlet port arranged at one of the first and second ends of the outlet manifold;

a collection manifold extending longitudinally from a first end to a second end, parallel and adjacent to the outlet manifold;

a plurality of first flow conduits extending in an extending direction from the inlet manifold to the collection manifold; and at least one second flow conduit extending from the collection manifold to the outlet manifold at an angle oblique to the extending direction of the first flow conduits, wherein the outlet manifold is at least partially located within a space between the inlet manifold and the collection manifold.

15. The evaporator of claim 14, wherein a longitudinal axis of the inlet manifold and a longitudinal axis of the outlet manifold are spaced apart in a direction parallel to a plane passing through the longitudinal axis of the inlet manifold and a longitudinal axis of the collection manifold by a distance, said distance being less than a distance between the longitudinal axis of the inlet manifold and the longitudinal axis of the collection manifold in a direction parallel to the plane passing through the longitudinal axis of the inlet manifold and the longitudinal axis of the collection manifold.

16. The evaporator of claim 14, wherein the space is defined between an inlet manifold extension plane, extending in a direction perpendicular to the plane passing through the longitudinal axis of the inlet manifold and the longitudinal axis of the collection manifold, and a collection manifold extension plane oriented in parallel with the inlet manifold extension plane, wherein both the inlet manifold extension plane and the collection manifold extension plane also extend in the longitudinal direction of the inlet and collection manifolds and further wherein the inlet manifold extension plane crosses at least a portion of the inlet manifold and the collection manifold extension plane crosses at least a portion of the collection manifold.

17. The evaporator of claim 16, wherein the outlet manifold crosses one of the inlet manifold and collection manifold planes.

* * * * *